US008047736B2

(12) United States Patent
Jordan

(10) Patent No.: US 8,047,736 B2
(45) Date of Patent: Nov. 1, 2011

(54) LIQUID DISPENSING BRUSH ASSEMBLY FOR A FLOOR SCRUBBER

(75) Inventor: Todd A. Jordan, Tallmadge, OH (US)

(73) Assignee: Jordan Power Equipment Co., Tallmadge, OH (US)

( * ) Notice: Subject to any disclaimer, the term of this patent is extended or adjusted under 35 U.S.C. 154(b) by 844 days.

(21) Appl. No.: 12/104,175

(22) Filed: Apr. 16, 2008

(65) Prior Publication Data

US 2009/0263177 A1 Oct. 22, 2009

(51) Int. Cl.

| | |
|---|---|
| ***A46B 11/04*** | (2006.01) |
| ***A47L 11/00*** | (2006.01) |
| ***B05B 3/10*** | (2006.01) |
| ***B05B 1/26*** | (2006.01) |

(52) U.S. Cl. ..... 401/284; 401/282; 401/286; 401/289; 15/50.1; 239/222.11; 239/224; 239/502; 239/522

(58) Field of Classification Search ..... 401/289, 401/286, 284, 282; 15/50.1; 239/223, 224, 239/222.1, 502, 522, 754

See application file for complete search history.

(56) References Cited

U.S. PATENT DOCUMENTS

| | | | | |
|---|---|---|---|---|
| 4,185,782 | A * | 1/1980 | Belrose | 239/222.11 |
| 6,009,593 | A * | 1/2000 | Crouser et al. | 15/50.1 |
| 7,299,521 | B2 * | 11/2007 | Theiss et al. | 15/50.1 |

* cited by examiner

*Primary Examiner* — David J. Walczak
*Assistant Examiner* — Bradley Oliver
(74) *Attorney, Agent, or Firm* — Sand & Sebolt

(57) ABSTRACT

A floor scrubber that includes a housing having a plurality of brush assemblies mounted therein. Each brush assembly is connected to a liquid supply by a tube. A disperser is mounted on each brush assembly and cleaning liquid flows from the liquid supply onto the disperser. As the brush assembly is rotated, the disperser rotates in unison with the assembly and the cleaning liquid is dispersed onto the bristles and onto the floor surface to be cleaned. The disperser includes a plurality of fins that aid in propelling the cleaning fluid onto the bristles.

25 Claims, 4 Drawing Sheets

LIQUID DISPENSING BRUSH ASSEMBLY FOR A FLOOR SCRUBBER

BACKGROUND OF THE INVENTION

1. Technical Field

The invention relates to machinery for scrubbing floors. More particularly, the invention relates to a brush assembly. Specifically, the invention relates to dispenser disk mounted on a brush assembly and which delivers cleaning liquid through a tube and onto fins that cause the liquid to be centrifugally dispersed upon rotation of the brush assembly.

2. Background Information

Household flooring can experience a range of soiling, from ground-in dirt to pet stains. Over the years, floor cleaning has evolved from scrubbing on one's hands and knees with a rag and soap, to machines specifically designed for this purpose.

Floor scrubbing machines can have many different configurations, but in general all include brush assemblies that incorporate scrubbing bristles, and a powered motor for driving the rotation of the brush assembly. Cleaning liquids are applied to the floor prior to rotation of the brush assembly in one of two ways. Firstly, the operator may squirt the liquid from a container directly onto the floor. Secondly, some scrubbing machines include a tube that terminates intermediate a plurality of scrubber heads. When the machine is applying the cleaning liquid, care must be taken to make sure the entire surface that is being cleaned is saturated. Typically the liquid drips down the tube in the center of the floor scrubber and directly onto the flooring, and the user must then push the machine around to spread the cleaning liquid. This procedure requires extra cleaning passes of the scrubber on the flooring, which leads to wasted energy, time, and possibly even distress to the floor itself.

Thus a need exists for a floor scrubber with a method of dispersing cleaning liquid that is more effective in saturating the scrubber head bristles and creates a larger radius of liquid dispersion.

BRIEF SUMMARY OF THE INVENTION

The device of the present invention comprises a floor scrubber that includes a housing having a plurality of brush assemblies mounted therein. Each brush assembly is connected to a liquid supply by a tube. A disperser is mounted on each brush assembly and cleaning liquid flows from the liquid supply onto the disperser. As the brush assembly is rotated, the disperser rotates in unison with the assembly and the cleaning liquid is dispersed onto the bristles and onto the floor surface to be cleaned. The disperser includes a plurality of fins that aid in propelling the cleaning fluid onto the bristles.

BRIEF DESCRIPTION OF THE SEVERAL VIEWS OF THE DRAWINGS

The preferred embodiments of the invention, illustrative of the best modes in which Applicant has contemplated applying the principals of the invention, are set forth in the following description and are shown in the drawings.

DETAILED DESCRIPTION OF THE INVENTION

Figure 1:
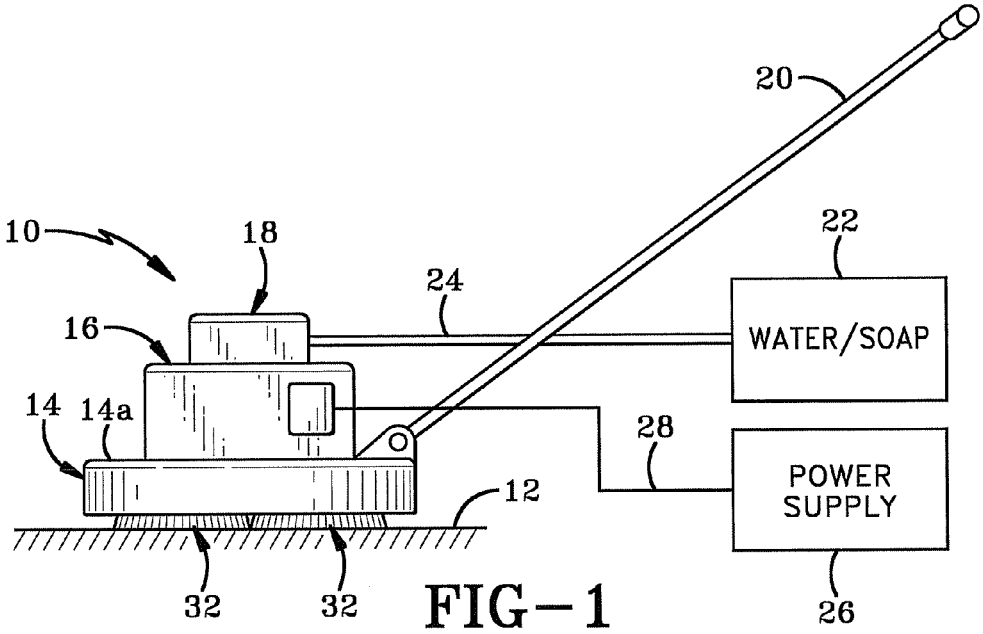
FIG. 1 is a side elevation view of a floor scrubber.

As shown in FIG. 1, a floor scrubber 10 rests on a floor surface 12. Floor scrubber 10 comprises a rotatable brush compartment 14, a motor compartment 16, and a liquid compartment 18. A handle 20 is pivotally mounted onto brush compartment 14 and is used to guide scrubber 10 over surface 12. A remote liquid supply 22 is operatively connected to liquid compartment 18 through a suitable means such as a hose 24. Soap may be added to the liquid supply 22 and introduced to liquid compartment 18 through hose 24. Alternatively, soap may be directly introduced into liquid compartment 18 and liquid supply 22 may provide water only. A remote power supply 26 is operationally connected via a cord 28 to motor compartment 16.

Figure 2:
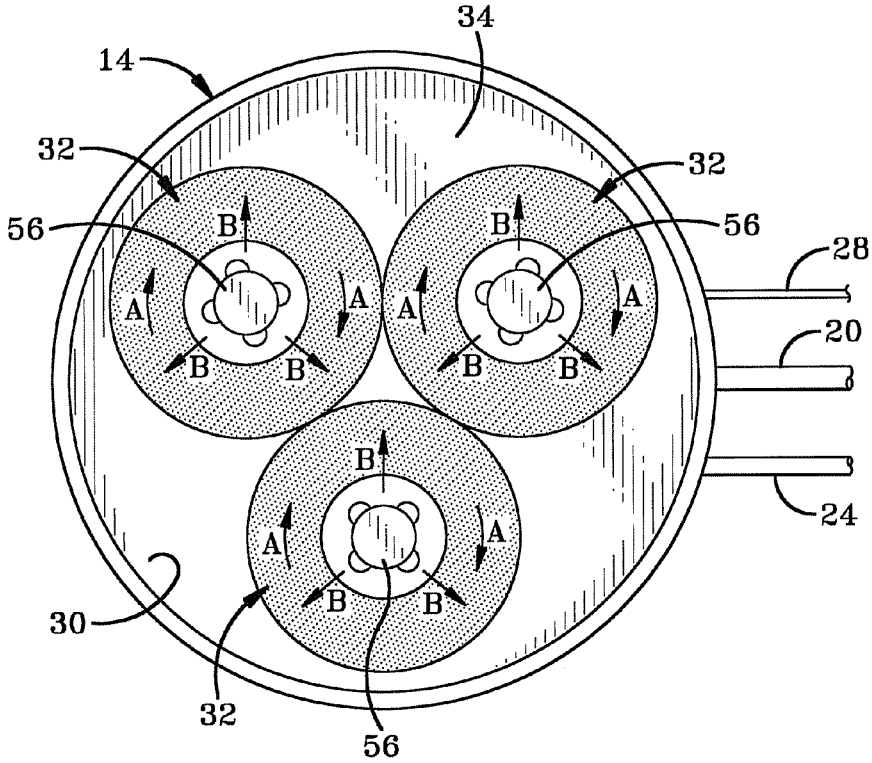
FIG. 2 is a bottom view of a brush assembly compartment on the floor scrubber.
Figure 3:
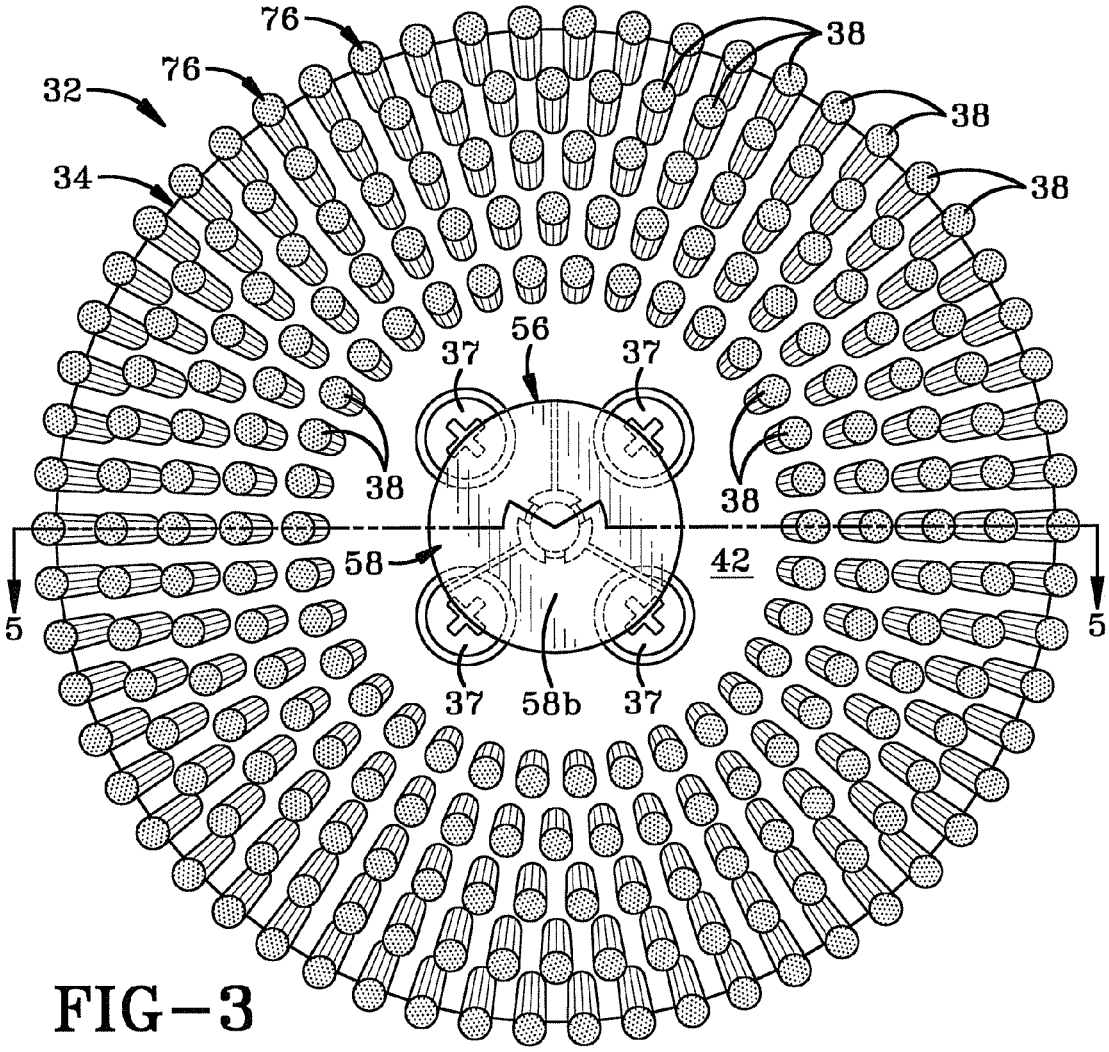
FIG. 3 is a bottom view of a single brush assembly, with a liquid delivery mechanism in accordance with the present invention shown in phantom.

Referring to FIG. 2, brush compartment 14 is a housing that defines a downward facing cavity 30. Three substantially identical brush assemblies 32 are mounted within brush compartment 14. Brush assemblies 32 extend outwardly from under brush compartment 14 to engage floor surface 12. Each brush assembly 32 is rotated about a central vertical axis upon actuation of a motor (not shown) housed in motor compartment 16. Arrow A in FIG. 2 shows the direction of rotation of each brush assembly 32. Arrow B shows the centrifugal force caused by said rotation.

Brush assemblies 32 are shown in greater detail in FIGS. 3-6. Each brush assembly 32 comprises a rigid base 34 which has an upper surface 34*a*, a lower surface 34*b* and side edges 34*c*. Base 34 further defines a central aperture 36 (FIG. 6) therein. A plurality of bristle columns 38 extend downwardly from lower surface 34*b* of base 34. Each bristle column 38 is made up of a plurality of bristles 40 (FIG. 5) that is all of approximately the same length. Lower surface 34*b* of base 34 includes a central region 42 (FIG. 3) which surrounds aperture 36 and is free of bristle columns 38. Bristle columns 38 are disposed in annular rows around central region 42.

Figure 5:
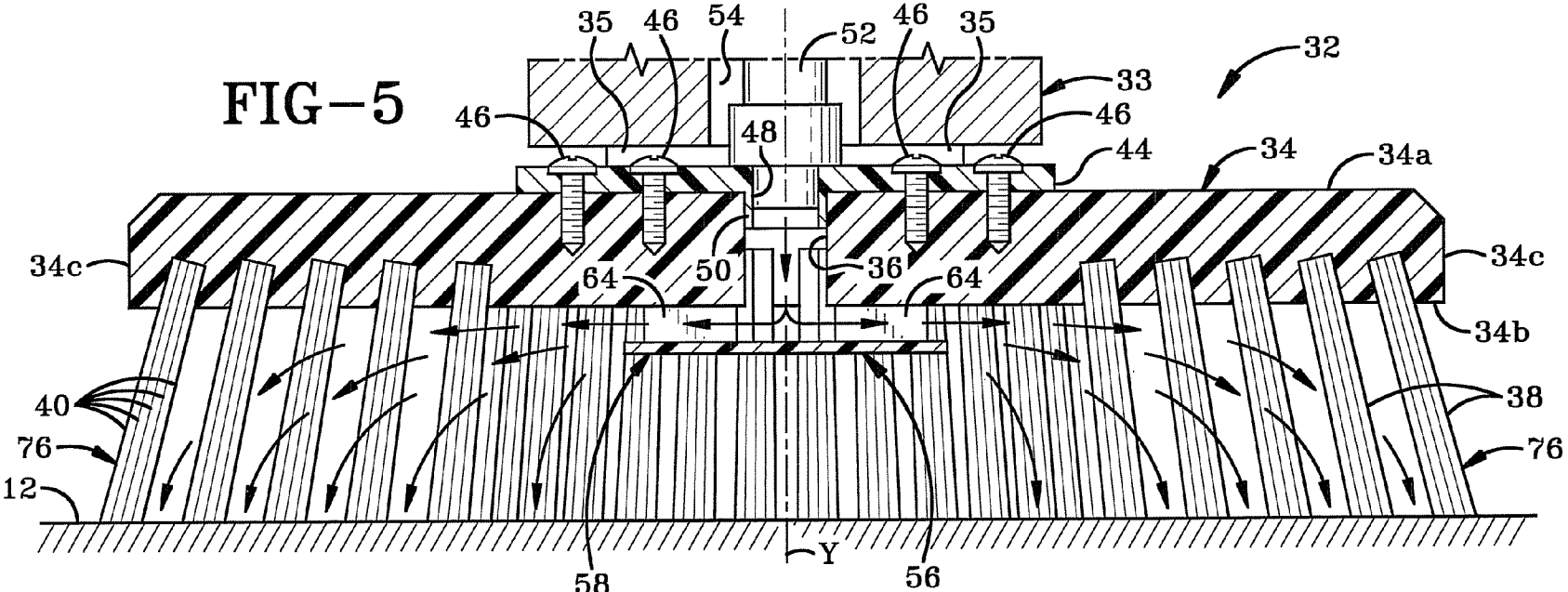
FIG. 5 is a cross-sectional view of the brush assembly taken through line 5-5 of FIG. 3.
Figure 6:
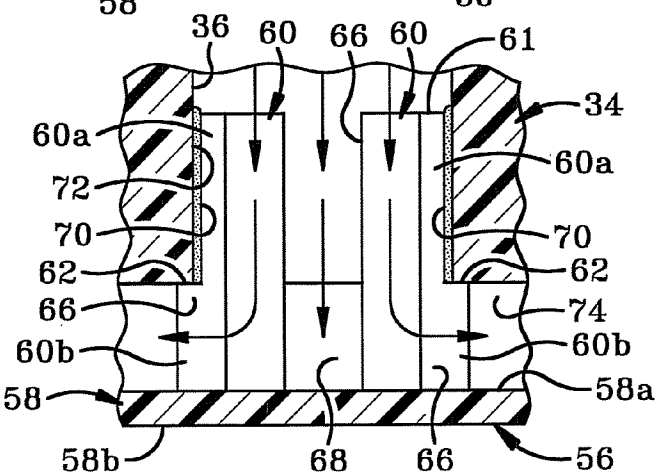
FIG. 6 is an enlarged cross-sectional view of the liquid delivery mechanism highlighted in FIG. 5.

As shown in FIG. 5, a connector 44 is secured to upper surface 34*a* of base 34 by a plurality of screws 46. Connector 44 has a central aperture 48 that aligns with aperture 36 in base 34 and a connector 44 having an outwardly extending annular flange 50 sized to frictionally engage in aperture 36 in base 34. Although not specifically shown in FIG. 5, connector 44 further includes four apertures that are disposed around central aperture 48. These additional apertures each have a rubber bushing 35 disposed therein. A screw 37 (FIG. 3) extends through each bushings 35 and into a housing 33 that is operationally connected to the motor in motor compartment 16. When the motor is actuated, housing 33 rotates and rotationally drives brush assembly 32.

A liquid dispersing tube 52 extends through an aperture 54 in the upper wall 14*a* of brush compartment 14 and into aperture 48 in connector 44. An interior surface of flange 50 frictionally engages tube 52. The bore of tube 52 terminates in aperture 36 in base 34. Although not specifically illustrated herein, additional tubing may extend from liquid compartment 18 through to the tube 52 of each brush assembly 32. Alternatively, tube 52 itself extends to liquid compartment 18. Liquid compartment 18 is therefore in fluid communication with the apertures 36 of each of the three brush assemblies 32.

Figure 4:
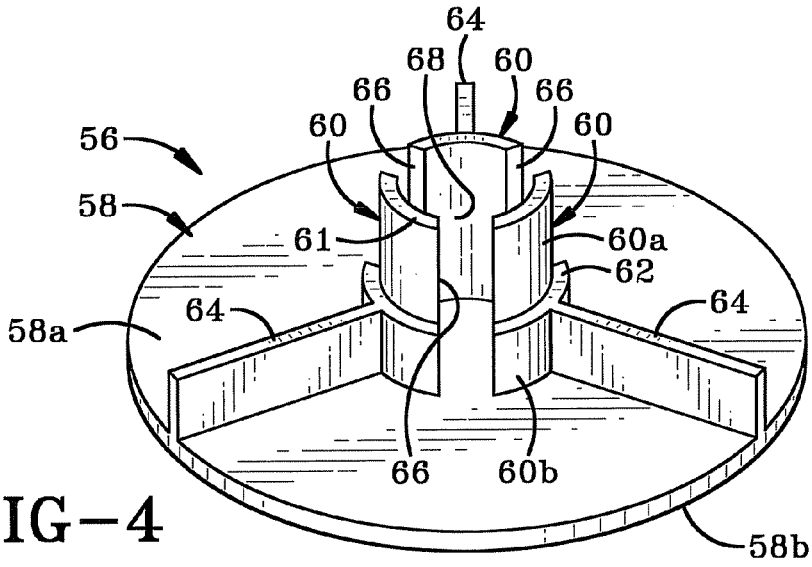
FIG. 4 is a perspective view of a liquid delivery mechanism, apart from the brush assembly.

In accordance with a specific feature of the present invention and as shown in FIGS. 2 and 4, a liquid disperser 56 is engaged with base 34 of each brush assembly 32. Liquid disperser 56 comprises a circularly-shaped, planar body 58 having a plurality of risers 60 extending outwardly away therefrom. Body 58 has an inner surface 58*a* and an outer surface 58*b*. Risers 60 extend outwardly away from inner surface 58*a* and are positioned relative to each other in such a manner that they form a shape complementary to that of aperture 36 in base 34. In the preferred embodiment of this invention, aperture 36 is generally circular in shape and risers 60 are disposed so as to form a circular shape. Furthermore, risers 60 are disposed in such a manner that they interferencely fit into aperture 36 of base 34. Each riser 60 is generally "C" shaped and includes a first portion 60*a* and a second portion 60*b*. Second portion 60*b* extends outwardly for a distance beyond first portion 60*a* so that a lip 62 is formed by an outermost surface of second portion 60*b*. A fin 64 extends radially outwardly from second portion 60*b* of each riser 60, and extends outwardly away from base 34 at generally a 90-degree angle to upper surface 36*a*. Preferably, the uppermost edge 64*a* of fin 64 is coplanar with lip 62. It will be understood, however, that fin 64 may be disposed at any other suitable angle to upper surface 34*a*, such as at 45-degrees.

A slot 66 is defined between each pair of adjacent risers 60. The slots 66 are each positioned intermediate two fins 64 and extend from base 34 to upper edge 61 of first portion 60*a* of risers 60. Risers 60 surround and define a central passageway 68 between them. Furthermore, risers 60 are distributed generally evenly around aperture 36. Fins 64 are disposed at approximately 120-degree angles to one another. Each slot 66 is located intermediate two adjacent fins 64.

The risers 60 of liquid disperser 56 are inserted into aperture 36 in base 34. Preferably an adhesive 70 is applied between first portions 60*a* of risers 60 and the interior wall 72 of base 34. Disperser 56 is pushed inwardly until lips 62 of risers 60 engage lower surface 34*b* of base 34. When fully installed, the body 58 of disperser 56 is oriented substantially parallel to lower surface 34*b* of base 34. Furthermore, because of the frictional or adhesive connection between disperser 56 and base 34, when brush assembly 32 is rotated, disperser 56 rotates in unison with brush assembly 32.

In accordance with another specific feature of the present invention, the passageway 68 in disperser 56 is substantially continuous with aperture 36 in base 34. Consequently, liquid that flows through tube 52 and into aperture 36, flows into passageway 68 of disperser 56 and outwardly therefrom through slots 66 between risers 60. Because lower surface 34*b* of base 34 engages lip 62 on second portion 60*b*, a gap 74 is created between lower surface 34*b* and inner surface 58*a* of body 58. This gap 74 is most easily seen in FIG. 6. Rotation of brush assembly 32 causes liquid to be centrifugally flung outwardly from slots 66 and onto body 58 of disperser 56 and into gap 74. Furthermore, the rotation of disperser 56 propels the liquid along fins 64 and outwardly into bristles 40 of bristle columns 38. This flow and dispersion of cleaning liquid is shown by the arrows in FIGS. 5-7. It should be noted that because central region 42 is free of bristle columns 38, the dispersion of cleaning liquid into bristles 40 is not hindered. Furthermore, liquid is flung outwardly by centrifugal force so that it reaches the outermost ring 76 of bristles columns 38.

Figure 7:
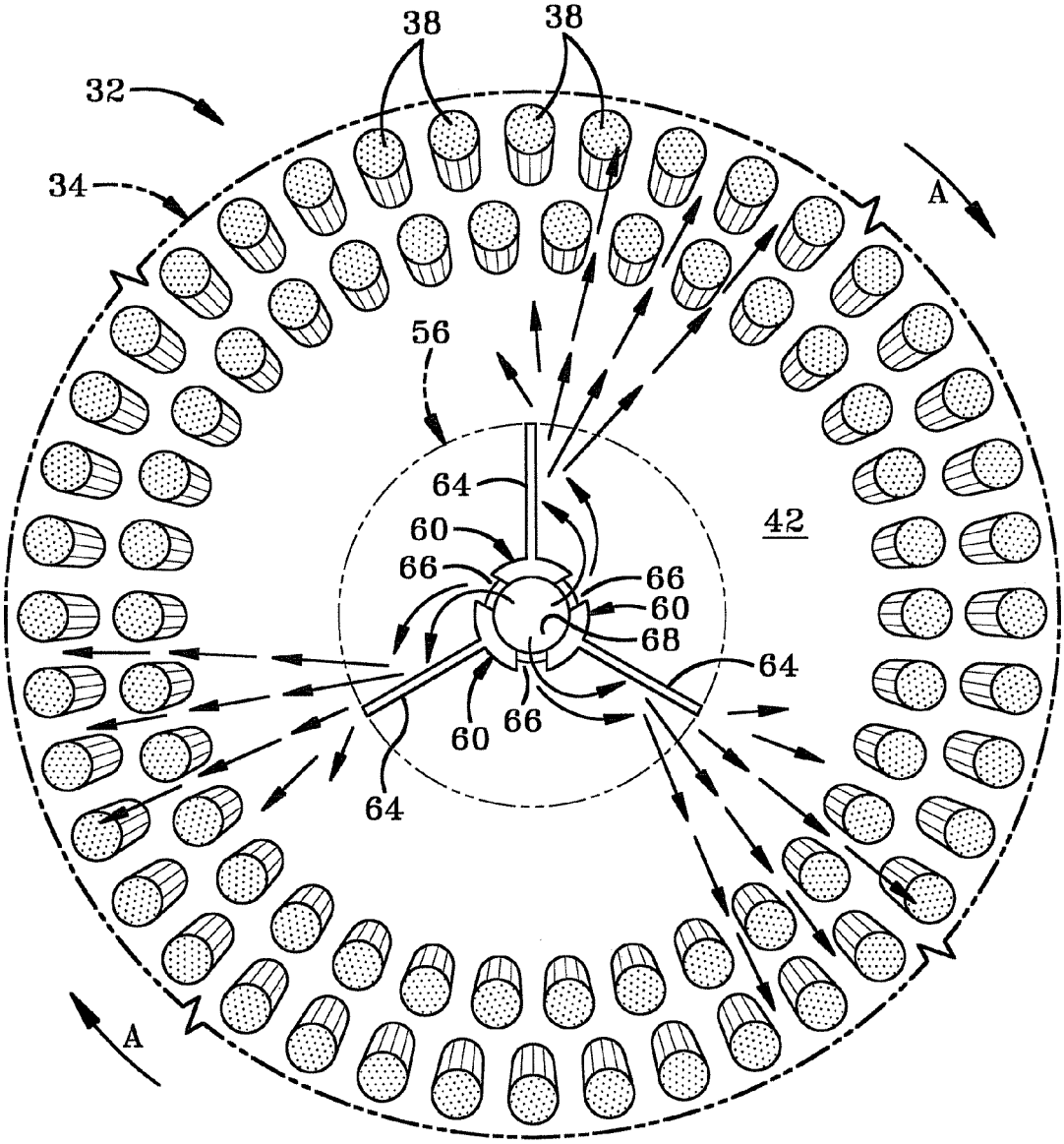
FIG. 7 is a partial bottom view of the brush assembly illustrating the liquid being dispensed therefrom.

In operation, the user connects hose 24 extending from liquid compartment 18 to liquid supply 22. The user further connects motor compartment 16 to power supply 26. Scrubber 10 is then activated. Liquid from liquid compartment 18 flows through tubing (if provided), through tubes 52 of each brush assembly 32 and into the aperture 36 of each base 34. When the motor is engaged, brush assemblies 32 start to rotate in the direction represented by the arrows marked "A". Dispersers 56 rotate with brush assemblies 32, thereby causing the liquid flowing through each tube 52 to be centrifugally propelled outwardly from passageway 68 through slots 66 and onto inner surface 58*a* of body 58. This process is shown in FIG. 7 which shows a partial bottom view of one of the brush assemblies 32 with some of the bristle columns 38 removed for the sake of clarity. Cleaning liquid flowing onto inner surface 58 momentarily collects on fins 30. The centrifugal forces acting on disperser 56 accelerate and disperse the cleaning liquid outwardly away from the fins 30 and into bristle columns 38. The cleaning liquid saturates bristle columns 38, and travels downwardly along bristles 40 and onto floor surface 12. The movement and rotation of bristle columns 38 and the ready availability of cleaning liquid on floor surface 12 results in dirt and debris being more easily scrubbed from floor surface 12. The user continues to manipulate scrubber 10 across floor surface 12 until the entire surface is scrubbed clean. During the entire cleaning process, liquid disperser 56 propels cleaning liquid evenly and efficiently over the area covered by rotating brush assemblies. Furthermore, the user does not have to stop occasionally and apply a quantity of cleaning fluid directly to floor surface 12. When scrubber 10 is deactivated, liquid ceases to flow from liquid compartment 18 to brush assemblies 32 and brush assemblies 32 cease to rotate.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A floor scrubber comprising:

a housing;

a brush assembly rotatably mounted on the housing, wherein said brush assembly has an upper surface, a lower surface and a plurality of bristles extending downwardly from the lower surface;

an aperture defined in the brush assembly and extending from the upper surface to the lower surface thereof, wherein the aperture is disposed intermediate the bristles and is of a first diameter;

a disperser mounted on the brush assembly a distance beneath the lower surface and directly below the aperture, wherein said disperser is of a second diameter that is greater than the first diameter of the aperture; and a liquid supply system in fluid communication with the brush assembly; said liquid supply system including a tube that terminates in the aperture, wherein the supply system is adapted to feed cleaning liquid through the tube and the aperture in the brush assembly and onto the disperser, and wherein the disperser is adapted to change the direction of the flow of all of the liquid exiting the aperture from a vertical direction to a radial direction and toward the plurality of bristles.

2. The floor scrubber as defined in claim 1, wherein the brush assembly further comprises a plurality of bristles adapted to engage the floor surface; and wherein the disperser is mounted intermediate the bristles, and wherein the disperser is adapted to disperse the cleaning liquid directly onto the bristles.

3. The floor scrubber as defined in claim 1, wherein the liquid supply system comprises:

a liquid compartment disposed proximate the brush assembly; and a tube that extends from the liquid compartment to the brush assembly.

4. The floor scrubber as defined in claim 1, wherein the disperser is one of frictionally engaged and adhesively connected to the brush assembly.

5. The floor scrubber as defined in claim 1, wherein the disperser rotates in unison with the brush assembly.

6. The floor scrubber as defined in claim 1, wherein the disperser comprises:

a planar member having an upper surface that is disposed opposite the lower surface of the brush assembly; and one or more fins extending upwardly from the upper surface of the planar member and toward the lower surface of the brush assembly.

7. The floor scrubber as defined in claim 6, wherein each of the one or more fins extends radially outwardly from a central region of the planar member.

8. A floor scrubber comprising:

a housing;

a brush assembly rotatably mounted on the housing;

a disperser mounted on the brush assembly; and a liquid supply system in fluid communication with the brush assembly; whereby the supply system is adapted to feed cleaning liquid through the brush assembly and onto the disperser and the disperser is adapted to feed that cleaning liquid onto a floor surface to be cleaned, and wherein the liquid supply system comprises:

a liquid compartment disposed proximate the brush assembly; and a tube that extends from the liquid compartment to the brush assembly; and wherein the brush assembly further defines an aperture extending from a first surface to an opposed second surface thereof, and wherein the tube terminates in the aperture proximate the first surface.

9. The floor scrubber as defined in claim 8, wherein the disperser is mounted a spaced distance from the second surface of the brush assembly and extends at least partially across a lower opening to the aperture.

10. The floor scrubber as defined in claim 9, further comprising a connector having an upper surface and a lower surface, wherein the lower surface is disposed adjacent the first surface of the brush assembly; and wherein;

a flange extends outwardly away from the connector and is configured to be received in an upper opening of the aperture; and a slot is defined in the flange and is adapted to enable liquid to flow through the connector and into the aperture in the brush assembly.

11. The floor scrubber as defined in claim 10, wherein the disperser comprises:

a body;

at least two risers extending outwardly away from an upper surface of the body, and a second slot defined between the two risers.

12. The floor scrubber as defined in claim 11, wherein each riser is substantially "C" shaped in cross-section.

13. The floor scrubber as defined in claim 12, wherein each riser includes a first portion disposed proximate the body and a second portion disposed remote from the body, and wherein the first portion extends radially further outwardly away from the aperture than does the second portion.

14. The floor scrubber as defined in claim 13, further comprising a lip on the first portion of the riser, wherein said lip engages the second surface of the brush assembly when the flange is received in the aperture.

15. The floor scrubber as defined in claim 10, wherein said riser further includes a first fin that extends radially outwardly away therefrom.

16. The floor scrubber as defined in claim 15, wherein the body has a planar inner surface and has a peripheral outer edge and wherein the first fin extends outwardly from the riser to the peripheral outer edge of the body.

17. The floor scrubber as defined in claim 16, wherein the first fin is disposed at an angle of 90-degrees to the planar inner surface of the body.

18. The floor scrubber as defined in claim 17, further comprising a second fin extending outwardly away from the riser a spaced distance away from the first fin, and wherein the second slot is disposed intermediate the first and second fins.

19. The floor scrubber as defined in claim 18, wherein the first and second fins are disposed equidistant from each other.

20. The floor scrubber as defined in claim 19, further comprising a third riser having a third fin radiating outwardly away therefrom; and further defining a third slot disposed between the third riser and one of the first and second risers; and wherein the first, second and third fins are disposed equidistant from each other.

21. The floor scrubber as defined in claim 18, wherein the second slot extends entirely from the inner surface of the base to an uppermost edge of the riser.

22. The floor scrubber as defined in claim 10, wherein an interior surface of the flange frictionally engages the tube.

23. A brush assembly for use in a floor scrubber; said brush assembly comprising:

a base;

an aperture extending through the base;

a disperser mounted a distance beneath a lower surface of the base proximate a plurality of scrubbing bristles, wherein the base is adapted to be rotatably engaged in a floor scrubber that includes a liquid supply; and is adapted to enable liquid to flow through said aperture and onto said disperser; and wherein the disperser is adapted to change the direction of the flow of all of the liquid exiting the aperture from a vertical direction to a radial direction and to be dispersed thereby onto the bristles.

24. The brush assembly as defined in claim 23, wherein the disperser comprises:

a planar member having an upper surface that is disposed opposite the lower surface of the brush assembly; and one or more fins extending upwardly from the upper surface of the planar member and toward the lower surface of the brush assembly.

25. The brush assembly as defined in claim 24, wherein each of the one or more fins extends radially outwardly from a central region of the planar member.

* * * * *

UNITED STATES PATENT AND TRADEMARK OFFICE

CERTIFICATE OF CORRECTION

PATENT NO. : 8,047,736 B2
APPLICATION NO. : 12/104175
DATED : November 1, 2011
INVENTOR(S) : Todd A. Jordan It is certified that error appears in the above-identified patent and that said Letters Patent is hereby corrected as shown below:

On the Title Page, left hand column paragraph (73) change the Assignee name from "Jordan Power Equipment Co." to --Jordan Power & Equipment Co.--

Signed and Sealed this
Twentieth Day of December, 2011

David J. Kappos

David J. Kappos
*Director of the United States Patent and Trademark Office*